US006397441B1

(12) United States Patent
Passini et al.

(10) Patent No.: US 6,397,441 B1
(45) Date of Patent: Jun. 4, 2002

(54) TEASELING MACHINE COMPRISING A SYSTEM FOR ADJUSTING THE PATH OF THE FABRIC THAT IS BEING PROCESSED

(75) Inventors: Gianluca Passini; Alberto Palombo, both of Prato (IT)

(73) Assignee: Tintoria Rifinizione Nuove Idee S.p.A. (IT)

( * ) Notice: Subject to any disclaimer, the term of this patent is extended or adjusted under 35 U.S.C. 154(b) by 0 days.

(21) Appl. No.: 09/509,960

(22) PCT Filed: Oct. 2, 1998

(86) PCT No.: PCT/IT98/00263

§ 371 (c)(1),
(2), (4) Date: Mar. 31, 2000

(87) PCT Pub. No.: WO99/18278

PCT Pub. Date: Apr. 15, 1999

(30) Foreign Application Priority Data

Oct. 8, 1997 (IT) ..... FI97A0222

(51) Int. Cl.[7] ..... D06C 11/00
(52) U.S. Cl. ..... 26/33; 26/32
(58) Field of Search ..... 26/33, 34, 35, 26/29 R, 31, 32, 27, 28, 25

(56) References Cited

U.S. PATENT DOCUMENTS

| | | | | |
|---|---|---|---|---|
| 151,957 | A | * | 6/1874 | Brown |
| 466,642 | A | * | 1/1892 | Woelfel |
| 2,466,348 | A | * | 4/1949 | Ambye ..... 26/31 |
| 2,472,584 | A | * | 6/1949 | Hadley ..... 26/29 R |
| 2,698,476 | A | | 1/1955 | Hadley |
| 2,923,046 | A | * | 2/1960 | Scholaert ..... 26/29 R |
| 3,102,320 | A | * | 9/1963 | Hayes ..... 26/31 |
| 3,246,378 | A | * | 4/1966 | Beckers ..... 26/31 |
| 3,553,801 | A | * | 1/1971 | Hadley ..... 26/28 |
| 3,740,788 | A | * | 6/1973 | Kingston ..... 26/31 |
| 4,463,483 | A | * | 8/1984 | Holm ..... 26/29 P |
| 4,803,761 | A | * | 2/1989 | Lungers ..... 26/35 |
| 5,084,948 | A | * | 2/1992 | Nielsen et al. ..... 26/29 R |
| 5,218,747 | A | * | 6/1993 | Riedel ..... 26/28 |
| 5,480,085 | A | * | 1/1996 | Smithe et al. ..... 226/44 |
| 5,517,736 | A | * | 5/1996 | Dalla Vecchia ..... 26/33 |
| 5,649,343 | A | * | 7/1997 | Profe ..... 26/33 |
| 6,141,842 | A | * | 11/2000 | Gardner et al. ..... 26/33 |

FOREIGN PATENT DOCUMENTS

| | | |
|---|---|---|
| DE | 87 07 501 U | 8/1987 |
| DE | 92 01 998 U | 4/1992 |
| EP | 0647813 A1 | 4/1995 |
| EP | 0 784 114 | 7/1997 |
| FR | 2418414 | 9/1979 |
| FR | 2648799 | 12/1990 |
| GB | 2064086 A | 6/1981 |
| WO | WO 95/29281 | 11/1995 |

* cited by examiner

*Primary Examiner*—Amy B. Vanatta
(74) *Attorney, Agent, or Firm*—McGlew and Tuttle, P.C.

(57) ABSTRACT

The teaseling machine, comprising a rotor, arranged at regular intervals around the periphery of which are a plurality of revolving cylinders with teaseling clothing, has, in the space between adjacent teaseling cylinders, a deflecting cylinder that extends parallel to the axis of the rotor and to the axis of the cylinders and that can be adjusted radially relative to the rotor so that it produces an adjustable deflection of the span of fabric between one cylinder and the next, thereby varying the teaseling or brushing action of the cylinder clothings.

15 Claims, 2 Drawing Sheets

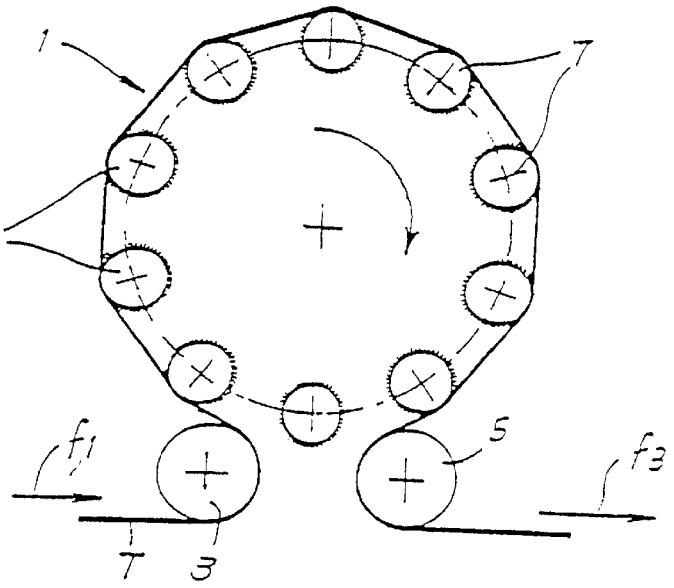
FIG. 1
(PRIOR ART)
FIG. 2
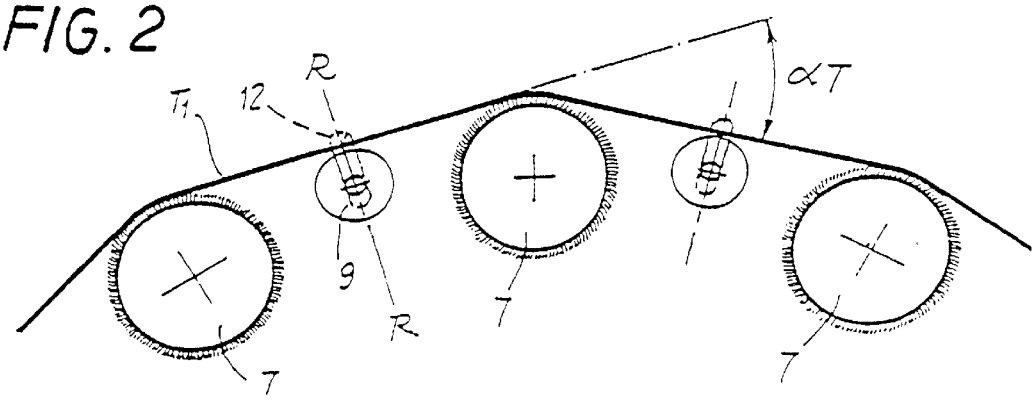
FIG. 3
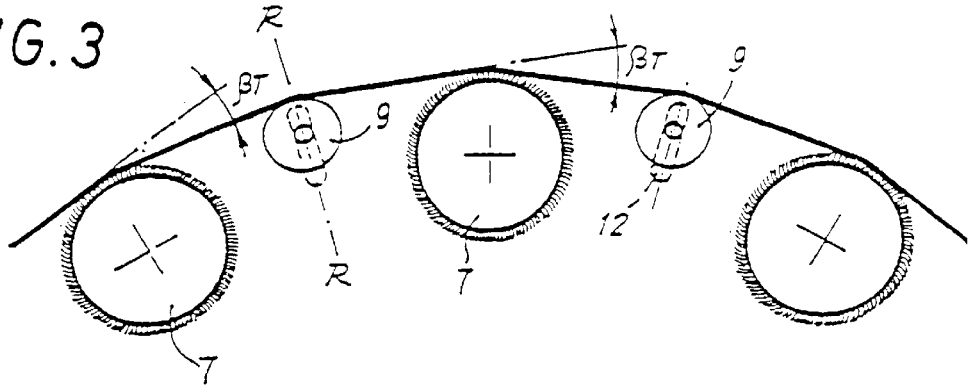

TEASELING MACHINE COMPRISING A SYSTEM FOR ADJUSTING THE PATH OF THE FABRIC THAT IS BEING PROCESSED

FIELD OF THE INVENTION

The invention relates to a fabric teaseling machine of the type that comprises a rotor to which the fabric to be processed is fed and from which said fabric is drawn; this rotor comprises a plurality of revolving cylinders provided with teaseling clothing and arranged on the periphery of the rotor with their axes parallel to that of said rotor and being rotated simultaneously with each other and independently of the revolution of the rotor by which the fabric is caused to advance. The fabric is deflected by the various teaseling cylinders, each of which deflects the fabric by a small amount toward the adjacent cylinder along a rectilinear span; the geometry of the assembly of rotor and teaseling cylinders is such that the fabric is deflected through a fixed angle by each cylinder, so that the amount of teaseling effected by the surface clothing of each cylinder is determined partly and uncertainly by the adjustment of the tension of the fabric that is sent around the cylinders of the rotor.

The invention relates to an improved teaseling machine with which it is possible to vary the deflection of the fabric from one teaseling cylinder to the next and so to vary the action of the teaseling clothing on the fabric, as a function of adjustment that may be carried out on the rotor of said machine. This makes it possible both to adjust the teaseling or brushing action and also to utilize differing teaseling clothings, including clothings with relatively flexible brushes or abrasive coverings. These and other objects and advantages will become evident on reading the following text.

BACKGROUND OF THE INVENTION.

A teaseling machine of the abovementioned type has already been proposed: it has groups of cylinders on individual mountings that can be moved angularly to put teaseling cylinders from each group, selected from a set of three,.teaseling cylinders, in an active position; in particular it provides for the activation of only one of the teaseling cylinders of a set of three or two teaseling cylinders of a set of three on each mounting designed to be regulated angularly at the periphery of the rotor. However, this arrangement does not make it possible to achieve the results obtained with the present invention.

SUMMARY AND OBJECTS OF THE INVENTION

In essence, according to the invention a teaseling machine—of the type comprising a rotor to which the fabric being processed is fed and from which it is drawn, and arranged in which rotor, at regular intervals around the periphery, are a plurality of revolving cylinders provided with teaseling or brushing clothing acting on the contacting fabric which is slightly deflected by adjacent cylinders—is characterized in that it comprises, in the space between adjacent cylinders, a deflecting means that extends parallel to the axis of the rotor and to the axis of the cylinders and that can be adjusted radially relative to the rotor so that it produces an adjustable deflection of the span of fabric between one cylinder and the next, thereby varying the teaseling action of the cylinder clothings.

Said deflecting means may advantageously be in the form of revolving rollers that are also free to revolve under the action of the fabric with which they come into contact.

The machine may comprise means for the simultaneous control of all of said deflecting means. Said deflecting means may be mounted on bearings supported on eccentrics or cranks or the like controlled by a control system common to all of these, such as a ring gear, a chain or the like.

A teaseling machine according to the invention can employ clothings for the teaseling cylinders composed of thin flexible wires that may be of relatively great length. The cylinders may possess teaseling clothings or abrasive coverings of differing characteristics.

A clearer understanding of the invention will be gained from the description and the accompanying drawing, which latter shows a practical, non-restrictive example of said invention.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

BRIEF DESCRIPTION OF THE DRAWINGS

In the drawings:

FIG. 1 is a diagram of a conventional teaseling machine of the type indicated earlier;

FIGS. 2 and 3 show an enlarged detail of the perimeter of a rotor constructed in accordance with the invention, in two different conditions of the apparatus that varies the position of the fabric with respect to the teaseling cylinders.

DESCRIPTION OF THE PREFERRED EMBODIMENT

Figure 4:
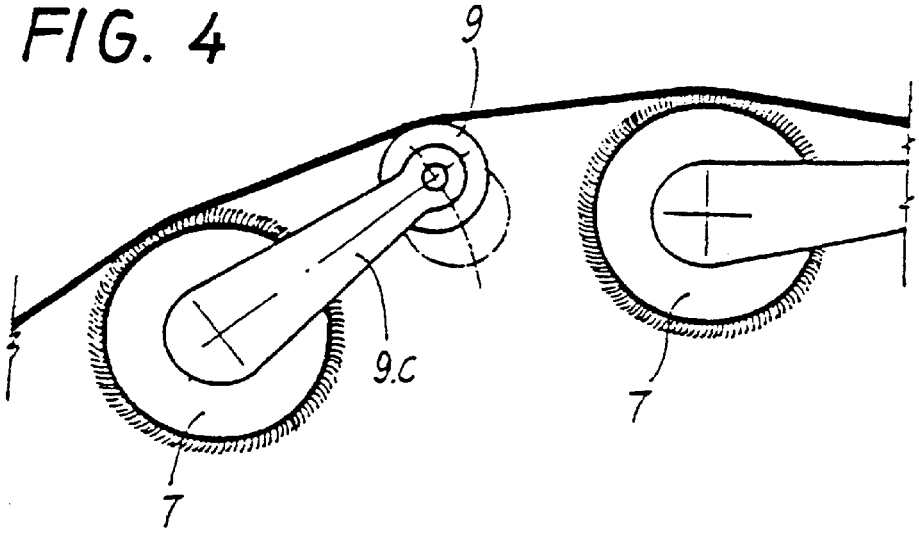
FIGS. 4 and 5 show possible modified schematic embodiments of the adjustment system according to the invention.

As illustrated in the accompanying drawing, and referring initially to FIG. 1, the number 1 denotes a rotor around which the fabric T arriving in the direction of arrow f1 is deflected at a deflecting roll 3, while 5 denotes another deflecting roll around which the fabric is deflected so as to be removed in the direction of arrow f3. The rotor has a plurality of teaseling cylinders 7 around its perimeter and these are made to revolve, each around its own axis in the same direction or in opposing directions either between one cylinder and the next or with respect to the direction of rotation of the rotor 1. This arrangement, which is known per se, is modified in accordance with the invention as follows, reference being made in particular to FIGS. 2 and 3.

FIG. 2 shows the position adopted by the fabric T when the apparatus in accordance with the invention is inactive. The fabric T travels between one teaseling cylinder 7 and the next along a rectilinear span T1 and is deflected by each cylinder through an angle $\alpha T$ which is fixed in the conventional arrangement of this teaseling machine shown schematically in FIG. 1. Since the deflection imposed by each teaseling cylinder 7 is fixed—in the conventional arrangement shown in FIG. 1—the teaseling action can in practice be modified only by varying the relative speeds of the cylinders and of the rotor and by varying the tension applied to the fabric in its path around the rotor 1.

By contrast, in accordance with the invention and with the diagrams of FIGS. 2 and 3, between each pair of adjacent cylinders 7, or between certain of the adjacent cylinders 7 is a deflecting means 9 which in the form shown in FIGS. 2 and 3 consists of a roller capable of revolving idly or otherwise with its axis parallel to that of the cylinders 7 and the rotor 1. The position of the deflecting roller 9 can be modified in the radial direction relative to the rotor 1, as indicated by the line R—R in FIGS. 2 and 3, by, for example, providing guide means 12 on the structure of the rotor 1 for sliding members which are adjusted for position with an adjustment facility that may be very fine, and then locked to support their respective rollers 9 in a number of positions, which may be varied between an inactive position as shown in FIG. 2—where the deflecting rollers 9 do not influence the path of the span T1 of the fabric between two cylinders 7 in which the deflecting roller 9 is placed —to one or more positions projecting beyond the path T1 so as to alter this path between two adjacent teaseling cylinders 7 (FIG. 3). In the inactive position of a roller 9, the deflection of the fabric by a teaseling cylinder 7 is labelled αT.

By positioning a deflecting roller 9 so as to interfere with the path T1, the span between one teaseling cylinder 7 and the adjacent cylinder 7 is deflected in such a way that the angle of deflection imposed by the teaseling cylinders 7 is modified; basically, the arc of deflection and of contact of the fabric T on the teaseling cylinders 7 between which the deflecting roller 9 is positioned is modified in such a way as to interfere with the span T1, as can be seen by comparing FIGS. 2 and 3: in FIG. 3 the angle of deflection imposed by each teaseling cylinder 7 (when a deflecting roller 9 is interfering with the path T1) is an angle βT that is less than the angle αT and that is adjustable by means of the centrifugal movement of the deflecting roller 9.

With this arrangement it is therefore possible to vary the action of the clothing of each teaseling cylinder 7 on the fabric without changing the clothing.

In particular with the arrangement in accordance with the invention it is possible to use teaseling cylinders with a clothing that may be of a type having even quite long springy metal wires, by adjusting the deflecting rollers 9 so as to prevent an excess of flexibility of the clothing or metal brushes, by adjusting the incidence, that is the interference, and the arc of fabric supported by the clothings of the teaseling cylinders 7.

Figure 5:
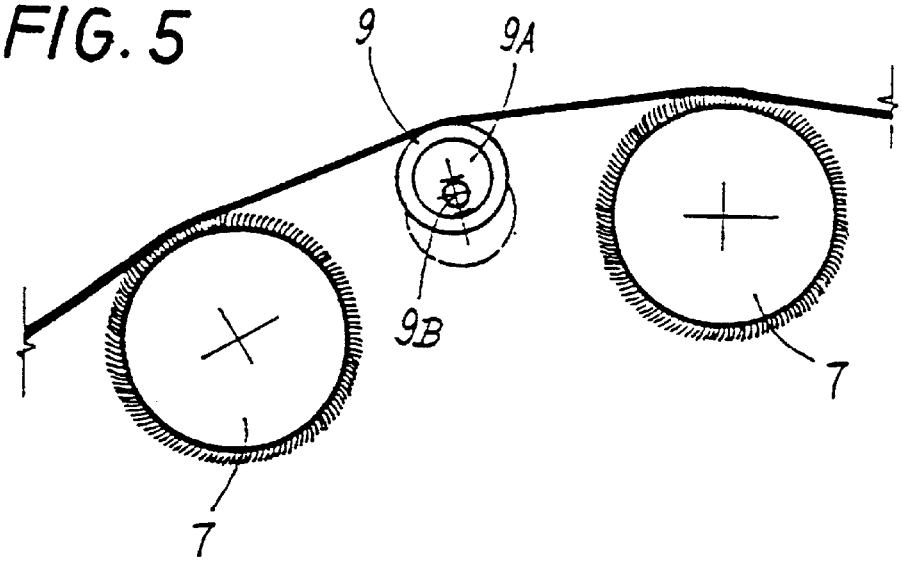

In essence it is possible to adjust the incidence of the fabric, i.e. the deflection of the fabric, on the individual teaseling cylinders 7. It is consequently also possible to use both paper or abrasive textile clothings and clothings with metal brushes having more than usually tall flexible filaments without the danger that the individual flexible wires will be bent and therefore prone to being deformed and becoming unusable; instead the fact that the deflecting means such as the rollers 9 can be adjusted also means that these types of brushes composed of metal or synthetic composite filaments or abrasive belts are useable. It is also possible to use teaseling l cylinders of different kinds alternating with each other by appropriate and selective adjustment of each of the deflecting means such as the deflecting rollers 9.

Where it is wished to allow for simultaneous and identical adjustment of all deflecting means such as the rollers 9, the rollers 9 may be mounted idly on spindles 9A eccentrically with respect to supporting shafts 9B as indicated in FIG. 5, the angular positions of the eccentrics 9A of the various rollers being modifiable by a single system that controls the angular adjustment of the eccentrics 9A. As a further alternative to the versions illustrated in FIGS. 2, 3 on the one hand and 5 on the other, each of the deflecting cylinders 9 can be mounted on a crank 9C that can be rotated about the axis of one of the teaseling cylinders 7 between which the means 9 is located; here again, angular control of the position of the crank 9C can be achieved on all the cranks or some of the cranks through a single control member, e.g. a ring gear, a toothed belt or the like.

Each deflecting means 9 may also be constructed differently from the form of an idle roller as illustrated in the drawing.

It will be understood that the drawing shows only an example given purely as a practical demonstration of the invention, which latter can be varied as regards shapes and arrangements without thereby departing from the scope of the concept on which said invention is based.

What is claimed is:

1. A teaseling machine comprising a rotor to which fabric being processed is fed and from which it is drawn; a plurality of revolving cylinders are arranged at regular intervals around a periphery of the rotor, said plurality of revolving cylinders are provided with clothing acting on the fabric which is slightly deflected by adjacent cylinders, a deflecting means is provided extending parallel to an axis of the rotor and to an axis of the cylinders and is adjustable radially relative to the rotor so that it produces an adjustable deflection of a span of fabric between one teaseling cylinder and the next, thereby varying the teaseling action of the cylinder clothings, the clothings of the cylinders including thin flexible synthetic composite filaments of relatively great length, said clothing having a brushing clothing action on the fabric.

2. The teaseling machine as claimed in claim 1, wherein: said deflecting means include revolving rollers that are also free to revolve under the action of the fabric with which they come in contact.

3. The machine as claimed in claim 1, further comprising means for the simultaneous control of all of said deflecting means.

4. The machine as claimed in claim 3, character in that said deflecting means are mounted on bearings supported by one of eccentrics and cranks controlled by a control system common to all of said one of said eccentrics and cranks.

5. The teaseling machine as claimed in claim 1 characterized in that the cylinder possess teaseling or brushing clothings of differing characteristics from each other.

6. The machine as claimed in claim 2, further comprising means for the simultaneous control of all of said deflecting means.

7. A teaseling machine for fabric, the machine comprising:

a rotor receivable of the fabric around a periphery of said rotor;

a plurality of brush cylinders arranged at intervals around said periphery of said rotor to contact the fabric, said brush cylinders being rotatable with respect to said rotor;

a plurality of flexible filaments extending from said plurality of brush cylinders, said flexible filaments being contactable with the fabric;

a plurality of deflectors arranged around said periphery of said rotor, each of said deflectors being arranged between two of said brush cylinders, said plurality of deflectors being movable into contact with the fabric to vary a deflection of the fabric around said plurality of said brush cylinders.

8. A teaseling machine in accordance with claim 7, wherein:

said flexible filaments include thin flexible synthetic composite filaments of relatively great length, said flexible filaments having a brushing clothing action on the fabric.

9. A teaseling machine in accordance with claim 7, further comprising:

a fabric supply feedable of the fabric around said rotor;

a fabric take up receivable of the fabric from said rotor, said rotor being rotatable to move said periphery of said rotor in a same direction as the fabric from said fabric supply to said fabric take up.

10. A teaseling machine in accordance with claim 7, wherein:

said flexible elements have a maximum deflection when said deflectors are arranged spaced from the fabric;

said deflectors hold the fabric away from said brush cylinders to selectively vary flexing of said flexible filaments and prevent maximum flexing of said flexible filaments.

11. A teaseling machine in accordance with claim 9, wherein:

said brush cylinders are rotatable both with and against said direction of the fabric.

12. A method for teaseling fabric, the method comprising the steps of:

providing a rotor with a plurality of brush cylinders arranged at intervals around said rotor, each said brush cylinder having a plurality of flexible filaments;

moving the fabric around a periphery of said rotor and into contact with said brush cylinders;

deflecting the fabric between said brush cylinders to vary an amount of contact the fabric has with said flexible filaments of said brush cylinders;

rotating said rotor to have said periphery of said rotor move in a same direction of the fabric;

rotating said brush cylinders with respect to said rotor.

13. A method in accordance with claim 12, wherein:

said deflecting varies an amount of flexing of said flexible filaments by the fabric.

14. A method in accordance with claim 12, wherein:

said flexible filaments include thin flexible synthetic composite filaments of relatively great length, said flexible filaments performing a brushing clothing action on the fabric.

15. A method in accordance with claim 12, wherein:

said rotating of said brush cylinders is both with and against said direction of the fabric.

* * * * *